US005765462A

United States Patent [19]

Mannio

[11] Patent Number: 5,765,462

[45] Date of Patent: Jun. 16, 1998

[54] WEB CUTTING DEVICE

[75] Inventor: Aaron Mannio, Järvenpää , Finland

[73] Assignee: Valmet Corporation, Helsinki, Finland

[21] Appl. No.: 638,517

[22] Filed: Apr. 26, 1996

[30] Foreign Application Priority Data

Apr. 26, 1995 [FI] Finland ..... 951982

[51] Int. Cl.[6] ..... B26D 5/12

[52] U.S. Cl. ..... 83/639.5; 91/321; 91/330; 83/639.1

[58] Field of Search ..... 83/639.1, 639.2, 83/639.5, 639.7, 620, 76, 588; 227/130; 91/321, 330, 341

[56] References Cited

U.S. PATENT DOCUMENTS

| | | | |
|---|---|---|---|
| 2,366,777 | 1/1945 | Farley et al. | 91/321 X |
| 2,784,619 | 3/1957 | Brauer et al. | 91/321 X |
| 3,505,918 | 4/1970 | Schneider | 83/639.1 X |
| 3,827,328 | 8/1974 | LaFlamme et al. | 83/639.1 X |
| 3,925,985 | 12/1975 | Peterson | 91/321 X |
| 4,022,096 | 5/1977 | Forichon | 83/639.1 X |
| 4,116,122 | 9/1978 | Linder et al. | 83/639.1 X |
| 4,295,411 | 10/1981 | Grantmyre et al. | 91/321 X |
| 4,667,553 | 5/1987 | Gerber et al. | 83/639.1 X |
| 4,844,114 | 7/1989 | Moberg et al. | 83/639.1 X |
| 5,176,057 | 1/1993 | Chun et al. | 83/139 |

*Primary Examiner*—Rinaldi I. Rada
*Assistant Examiner*—Boyer Ashley
*Attorney, Agent, or Firm*—Steinberg, Raskin & Davidson, P.C.

[57] ABSTRACT

A web cutting device for cutting a web in which a an actuator acts upon a cutter blade so as to produce the cutting stroke. The actuator includes several cylinders placed inside a container or alternatively a number of cylinders placed individually in a plurality of containers. Each of the cylinders includes a piston and a piston rod, the piston rods being attached to the cutter blade with a certain spacing along the length of the cutter blade in a direction transverse to the running direction of the web.

15 Claims, 2 Drawing Sheets

WEB CUTTING DEVICE

FIELD OF THE INVENTION

The present invention relates to a web cutting device including a cutter blade and an actuator which operatively acts upon the cutter blade so as to produce a cutting stroke for cutting a web.

The present invention also relates to a method for cutting a web across its width.

BACKGROUND OF THE INVENTION

In devices for treating a paper web, such as, for example, in paper machine and coating machines, cutting devices are used to cut off the web at a number of positions when any failure takes place in the operation of the machine, such as an uncontrolled web break. The function of the web cutting is to protect such items or equipment that might be damaged when the paper web proceeds through the machine in a wrinkled state and having lost its tension inside the machine, for example, through a coating station or through a calender with soft calender rolls.

Further, cutting devices are used in a reel-up of the web as a part of the machine-reel change equipment.

When the running speeds of the machines used in the manufacture and finishing of paper (for example, during coating, calendering, slitting) are increased even to levels higher than about 2500 meters per minute, requirements are imposed on the operation of the web cutting devices. These requirements are a shorter reaction time, smaller size for the device, and higher speed of movement of the blade at the moment of cutting.

The prior art paper web cutting devices have a construction in which a number of pneumatic cylinders arranged at a distance from one another operatively act upon the cutter blade of the cutting device. After cutting, the pneumatic cylinders return the cutter blade back to its initial position. However, by means of these prior art devices, the cutter blade cannot be given a sufficiently high speed, for which reason an excessively long time delay occurs in the cutting which results in an incorrect cutting point, i.e., the cutting is too inaccurate in respect of the location of the web at which cutting is desired. An excessively slow movement of the cutter blade also results in an inferior cutting result in the paper web. Thus, the prior art devices have the disadvantages of insufficient speed and inferior cutting quality.

At present, an accuracy of about 0.3 meter is commonly required from a paper web cutting device. This means that, from the cutting command, the time delay must be such that the cutting error is less than the required limit of accuracy of 0.3 m. In the prior art devices, in which a number of pneumatic cylinders placed at a distance from one another are used, the time delay is of an order of about 0.25 second. With the present-day web speeds (e.g., about 1200 meters per minute about), this corresponds to a distance of about 5 meters in the web. If an error of 10% is permitted in the cutting, it results from this that the accuracy of this prior art cutting device is just of an order of about 0.5 meter. This is higher than the desired accuracy limit and moreover, increases as the web running speed increases.

Finnish Patent Application No. 860797 describes a paper web cutting device which includes a frame part and a blade device arranged on the frame part for cutting the paper web, as well as an actuator for producing the power necessary for the blade device for cutting the paper web. The actuator for producing the power necessary for the blade device to cut off the paper web is a spring device in which cutting energy has been stored. The cutting device is provided with at least one charging device for charging the spring device. The charging devices are hoses expandable by means of compressed air or equivalent.

German Utility Model Application G-9413363.8 describes a paper web cutting device fitted to operate so that it cuts off a paper web moving in a space between two rolls over which the web runs. The cutting device includes a toothed cutter blade and an actuator arranged to bring the cutter blade, which is attached to a lever arm, into a cutting movement by the intermediate of the lever arm. The actuator can be pneumatic, hydraulic, electric, piezoelectric, magnetic or inductive.

Even though, by means of these prior art cutting devices, a quick cutting of the web is aimed at, these prior art devices involve a number of significant drawbacks. The cutting device requires an abundant space and, moreover, its operation is not very adequate in view of safety considerations and can cause risky situations, for example, for people working at paper and coating machines. A further drawback of these prior art devices is the long delay in accelerating the blade beam, i.e., the beam on which the cutting blade is mounted, to the cutting speed.

The prior art cutting devices are massive, and a large amount of power is required to produce the necessary stroke speed. Also, stopping of the massive cutter blade is problematic, and the massive cutter blade produces high dynamic loads in the cutting device, because of which, the constructions must be robust and quite large. For this reason, the prior art cutting devices are unfortunately spacious and, moreover, the high dynamic loads applied to the cutting device are also effective in the environment in direct vicinity of the cutting device.

Finnish Patent Application No. 944816 describes a web cutting device including a frame part and a blade device arranged in the frame part to perform the cutting of the web. A first frame part and a second frame part of the frame part are curved faces between which there is an annular space. At least one of the curved faces is displaceable, the cutter blade being fitted to be charged in the annular space. There is an opening for the striking opening of the cutter blade at least in one of the frame parts.

OBJECTS AND SUMMARY OF THE INVENTION

Accordingly, an object of the present invention is to provide an improvement over the prior art web cutting devices.

It is a more specific object of the present invention to provide a web cutting device and method whose cutting result is as short as possible in the direction of progress of the web.

It is a further object of the present invention to provide a web cutting device and method which is suitable both for paper web and board web and by whose means the web can be cut off at once across substantially the entire width of the web.

It is still a further object of the present invention to provide a cutting device and method which permits a cutting stroke as rapid as possible and which also permits to make the construction of the cutting device of a size as small as possible.

The objects of the present invention mentioned above, and others, are achieved by means of a cutting device including an actuator which comprises a number of cylinders placed inside a container, or alternatively of a number of cylinders placed individually in a plurality of containers. Each of the cylinders includes a piston and a piston rod coupled thereto. The piston rods are attached to an elongate cutter blade, which is adapted to extend across substantially the entire width of the web, with a certain spacing in the longitudinal direction of the cutter blade. More generally, the device for cutting a web in accordance with the invention comprises cutting means for cutting the web, and actuator means coupled to the cutting means for moving the cutting means into engagement with the web such that the cutting means cut the web. The actuator means comprise at least one container having an interior compartment fillable with a compressed fluid and a plurality of cylinders arranged inside the container(s). Each of the cylinders includes a movable piston and a piston rod coupled to the piston. The piston rods are attached to the cutting means at a distance from one another. To produce a cutting stroke, the actuator means comprise means for fluidly coupling an area above the pistons to the interior compartment such that the compressed fluid in the interior compartment of the container(s) is directed to move the pistons and the piston rods coupled thereto and thus the cutting means.

By means of the cutting device in accordance with the present invention, a number of remarkable advantages are obtained, of which the following should be mentioned. The stroke of the cutting device is very quick, and the size of the cutting device is as small as possible. By means of the cutting device, it is possible to cut off the paper or board web at once across substantially the entire width of the web so that the distance over which the web is cut is as short as possible in the direction of progress of the web. As a result thereof, the "tail" produced, for example, in connection with splicing, can be made considerably shorter than by means of the prior art cutting devices. Also, placement and fitting of the small-size cutting device in accordance with the invention in different environments is far easier than fitting of the prior art cutting devices.

With a cutting device in accordance with the present invention, a high stroke speed of about 15 meters per second of the cutter blade is achieved with a very good reproducibility. The quick stroke of the cutter blade of the cutting device is produced by means of large-area, quickly opening, pressure-controlled control valves of cylinders attached to the cutter blade as well as by preferably placing the cylinders in the interior of the pressure container so that the passage of the compressed air from the pressure container to the cylinders is as short as possible. The moving parts of the cutting device in accordance with the invention comprise the cutter blade and piston rods and pistons attached to the cutter blade with a certain spacing. The proportion of the weight of the cutter blade to the total weight of all the moving parts is optimally about 70%. Thus, the lightness of the cutter blade contributes to its rapid movement to cut the web.

The method for cutting a web in accordance with the invention comprises the steps of arranging a plurality of cylinders in at least one container having a pressurizeable interior compartment, arranging a piston and a piston rod coupled thereto in each of the cylinders, attaching each of the piston rods to a cutting blade at different locations spaced from one another along the length of the cutting blade, pressurizing the interior compartment of the container(s) with a compressed fluid, and producing a cutting stroke for cutting the web by directing the compressed fluid from the interior compartment into engagement with the pistons to cause the pistons, the piston rods coupled thereto and thus the cutting blade attached to the piston rods to move. The cylinders may be arranged in the interior compartment of the container(s) such that each of the cylinders has an open end at which a respective one of the pistons is situated, and a flow passage is formed between the interior compartment and an area behind the pistons in the cylinders into which the compressed fluid operatively flows. The flow of compressed fluid from the interior compartment into engagement with the pistons can be controlled by arranging control valves in connection with the cylinders to operatively open a passage between the interior compartment of the container(s) and an area behind the pistons. An application of pressure into the area behind the pistons causes the pistons to move and thus move the piston rods and the cutting blade attached thereto to cut the web. Opening of the passage achieved by movement of the control valves can be attained by generating a pressure difference between two sides of the control valves.

The invention will be described in detail with reference to some preferred embodiments of the invention illustrated in the figures in the accompanying drawings. The invention is, however, not confined to the illustrated embodiments alone.

BRIEF DESCRIPTION OF THE DRAWINGS

The following drawings are illustrative of embodiments of the invention and are not meant to limit the scope of the invention as encompassed by the claims.

DETAILED DESCRIPTION OF THE INVENTION

Figure 1:
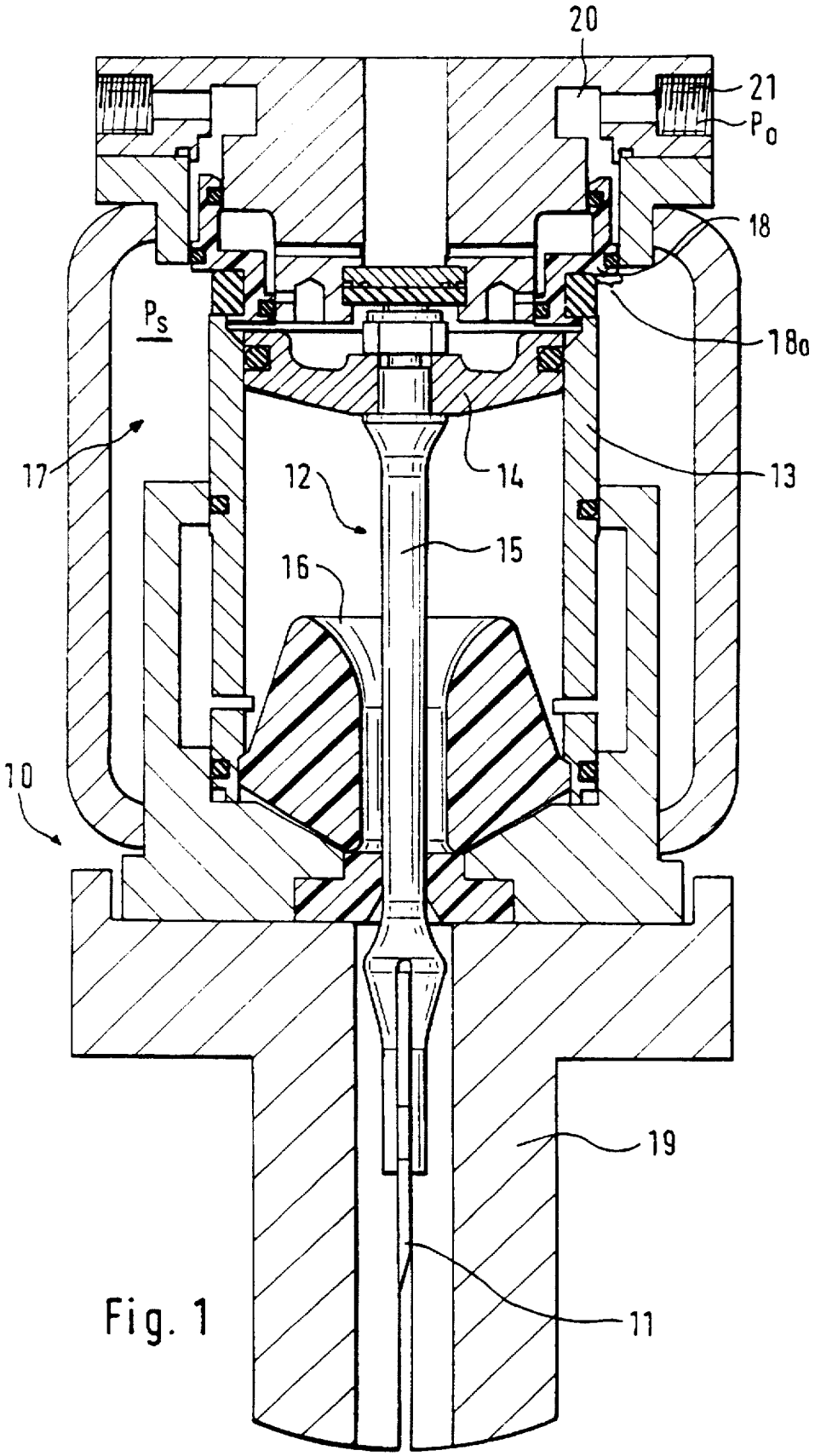
FIG. 1 is a schematic sectional view of a preferred embodiment of the cutting device in accordance with the invention which is used in the method in accordance with the invention.
Figure 2:
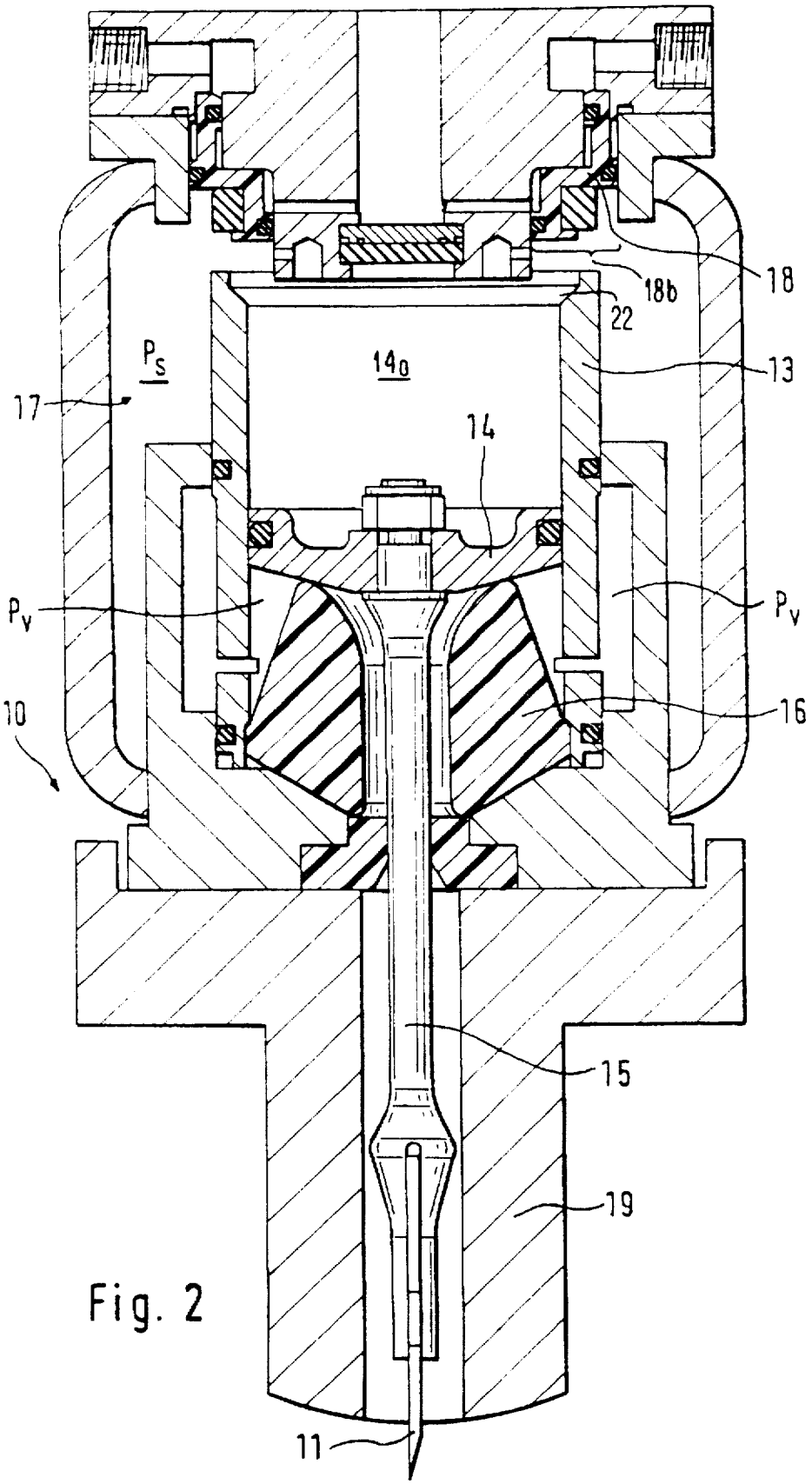
FIG. 2 is a schematic sectional view of the cutter device shown in FIG. 1 in situation in which the cutter blade has carried out the cutting movement.

Referring to the accompanying drawings wherein the same reference numerals refer to the same or similar elements, in the embodiment shown in FIGS. 1 and 2, the cutting device in accordance with the invention is denoted generally by reference numeral 10. The cutting device 10 includes a cutter blade 11 and an actuator 12 which is fitted to act upon the cutter blade 11 to produce the cutting stroke. The cutter blade 11 can be elongate and adapted to extend across substantially the entire width of the web, i.e., the longitudinal direction of the cutter blade 11 is substantially coextensive with the width of the web. In this embodiment, the actuator 12 comprises a number of cylinders 13, in each of which there is a piston 14 and a piston rod 15 coupled to the piston 14. The piston rods 15 are also attached to the cutter blade 11 with a certain spacing from one another in the longitudinal direction of the cutter blade 11. The spacing of the attachment of the piston rods 15 to the cutter blade 11 depends on the number of the cylinders 13. The number of the cylinders 13 is preferably from about 6 to about 14, and a number that is recommended in particular is from about 8 to about 10, depending on the length of the cutter blade 11 in the direction transverse to the running direction of the web, i.e., its longitudinal direction. The cylinders 13 are placed in the interior of a container 17, and a pressure is present in the container 17, i.e., a compressed fluid, and is denoted by the letter $P_S$. Each cylinder 13 can also have an individual container 17 of its own. The movement of the piston 14 is stopped by means of a stop cushion 16 or equivalent movement arresting means. The operation of the pistons 14 is controlled by means of control valves 18 or other equivalent control means coupled to respective ones of the pistons 14. The control pressure is denoted by the letter $P_O$, and the back pressure is denoted by the letter $P_V$. The magnitude of the control pressure $P_O$ in a control chamber 20 is preferably about 80% of the pressure $P_S$ in the container 17. Guide means for guiding the movement of the cutter blade 11 is denoted by the reference numeral 19. The piston 14 can be returned either by means of the back pressure $P_V$ effective in an area below the piston 14 (and which is greater than the pressure $P_S$ during movement of the piston 14 from the cutting position to the non-cutting position) or by passing a pressure present in a separate pipe system to the area below the piston 14 (which may also be greater than the pressure $P_S$ for the duration of the movement of the piston 14 from the cutting position to the non-cutting position) or other equivalent piston return means.

In the cutting device 10 in accordance with the invention, the control valves 18 are opened in a highly efficient manner because, when the slide of the control valve 18 starts moving, the pressure $P_S$ in the container 17 can act upon the slide of the control valve 18 on an area that is multiple (or increased) in comparison with a situation in which the control valve 18 is fully closed. In this manner, since the force of opening of the control valves 18 depends on area, i.e., force equals pressure times area, an increase in the area on which the pressure is effective increases the force moving the control valves 18 into an open position. The control valves 18 have a first surface area or portion 18*a* exposed to the compressed fluid in the interior compartment of the container 17 when the control valve is in a closed position and a second surface area or portion 18*b* which is larger than the first surface area when the control valve 18 is in an opening position. The second surface area increases as the control valve is opened. Thus, in the cutting device 10 in accordance with the invention, a rapid stroke of the cutter blade 11 is produced by means of the large-area, rapidly opening, pressure-controlled control valves 18 of the cylinders 13 attached to the cutter blade 11 as well as by preferably placing the cylinders 13 in the interior of the pressure container 17 so that the passage of the compressed air from the pressure container 17 into the cylinders 13 is as short as possible. Thus, in the cutting device 10 in accordance with the present invention, it has been successfully possible to make the cutter blade 11 and the devices that move it as of a weight as low as possible. The moving parts essentially consist of the cutter blade 11 and piston rods 15 and pistons 14 attached to the cutter blade 11 with a certain spacing. The proportion of the weight of the cutter blade 11 to the total weight of all the moving parts is optimally about 70%.

In the cutting device 10 in accordance with the invention, the operation of the control valves 18 has been made very accurate, and the speed of opening of the control valves 18 is very high. This has been achieved by reducing the weight of the slide in the control valve 18 and the proportions of the areas so that the control valve 18 is opened with a very high control pressure $P_O$, preferably with a pressure that is of an order of from about 2.3 to about 7 bar if the pressure $P_S$ in the container 17 is of an order of from about 3 to about 10 bar. The control valve 18 is caused to open by a specific difference between pressures $P_S$ and $P_O$, i.e., when pressure $P_O$ is less than pressure of $P_S$ to a certain extent, control valve 18 will be forced upward opening a passage 22 to direct the pressure $P_S$ to act on piston 14, on an area which is continually increasing as the control valves 18 open. In other words, the compressed fluid will flow through passage 22 into an area or chamber 14*a* above the piston 14 (in the illustrated embodiment) and force the piston downward. This passage 22 constitutes means for fluidly coupling the chamber 14*a* above the pistons 14 to the interior compartment. Preferably, the pressure $P_S$ in the container 17 is about 4 bar. The high level of the control pressure $P_O$, makes the operation of the control valve 18 very accurate, because the discharging of the control valve 18 takes place so that the control pressure $P_O$ of the control valve 18 is eliminated substantially at the same time from all the control chambers 20. The more rapidly the pressure $P_O$ in the control chambers 20 is lowered, the more quickly is the pressure range bypassed in which all the control valves 18 are opened, i.e., the required difference between pressures $P_S$ and $P_O$. The pressure level has a substantial effect on the speed of lowering of pressure.

With a cutting device in accordance with the present invention, a high stroke speed of about 15 meters per second of the cutter blade 11 is achieved with a very good reproducibility. For this reason, by means of the cutting device 10 in accordance with the invention, it is possible to cut off the web at once across the entire width of the web so that the cutting result in as short as possible in the direction of progress of the web, and thus, the "tail" produced, for example, in connection with splicing operations can be made considerably shorter than by means of the prior art cutting devices. The cutting device 10 in accordance with the invention is also of small size, so that its fitting in different environments is very easy.

From the point of view of the speed of the cutter blade 11 of the cutting device 10 in accordance with the invention, it is important that the cylinders 13 should operate at the same time, i.e., in a synchronized manner. Also, in view of the service life of the blade 11, it is important that the pistons 14 collide against their stop cushions 16 as precisely at the same time as possible. The timing can be affected by means of regulation of the flow resistances in the system of control pressure pipes 21 in flow communication with the control chambers 20. For this reason, the control pressure pipes 21 of all the control valves 18 should preferably be made equally long, and the control pipes should be provided with an equal number of elbows, i.e., to provide equal length paths. All the cylinders 13 of the cutting device 10 in accordance with the invention can be easily made to operate within one millisecond. During one millisecond, the piston 14 proceeds a distance of about 1 mm from its starting point. This maximal phase difference is, in fact, theoretical, for the rigidity of the cutter blade 11 in the direction of the force of the piston 14 is high enough so that the cutter blade 11 can equalize differences of this magnitude.

The examples provided above are not meant to be exclusive. Many other variations of the present invention would be obvious to those skilled in the art, and are contemplated to be within the scope of the appended claims.

I claim:

1. In combination with a paper machine or a paper finishing machine through which a web runs, a device for cutting the web, comprising cutting means for cutting the web during its run through the paper machine or paper finishing machine, and actuator means coupled to said cutting means for moving said cutting means into engagement with the web such that said cutting means cuts the web, said actuator means comprising at least one container having an interior compartment, pressurizing means for pressurizing said interior compartment, said pressurizing means comprising a compressed fluid received in the interior compartment.

a plurality of cylinders arranged inside said at least one container, each of said cylinders including a movable piston, a chamber defined in part by said piston and a piston rod coupled to said piston, said piston rods being attached to said cutting means at a distance from one another, and means for coupling said chambers defined in part by said pistons in flow communication with the compressed fluid in the interior compartment of said at least one container to cause the compressed fluid in the interior compartment of said at least one container to flow into said chambers against said pistons and move said pistons, said piston rods, and said cutting means.

2. The web cutting device of claim 1, wherein said at least one container consists of a single container, all of said cylinders being arranged in said container.

3. The web cutting device of claim 1, wherein said at least one container comprises a plurality of containers, one of said cylinders being arranged in each of said containers.

4. The web cutting device of claim 1, wherein said cutting means comprises an elongate cutter blade extending across substantially an entire width of the web, said piston rods being spaced along the length of said cutter blade.

5. The web cutting device of claim 1, further comprising arresting means for arresting the movement of said pistons, said arresting means comprise stop cushions arranged in each of said cylinders.

6. The web cutting device of claim 1, further comprising 6 to 14 of said cylinders spaced at specific locations across a width of the web depending on a length of said cutting means.

7. The web cutting device of claim 1, wherein said cutting means have a first weight and said cutting means, said pistons and said piston rods have a total second weight, a proportion of the first weight of said cutting means to the total second weight of said cutting means, said pistons and said piston rods being about 70%.

8. The web cutting device of claim 1, wherein said coupling means are structured and arranged to couple said chambers in said pistons in all of said cylinders substantially simultaneously in flow communication with the compressed fluid in the interior compartment such that a stroke speed of said cutting means is of an order of about 15 meters per second.

9. The web cutting device of claim 1, further comprising guide means coupled to said at least one cylinder for guiding the movement of said piston rods.

10. The web cutting device of claim 1, further comprising return means for returning said pistons to a rest position from an operative position in which the web is cut.

11. The web cutting device of claim 1, wherein the interior compartment of said at least one container is pressurized by the compressed fluid to a pressure of about 3 bar to about 10 bar, said cylinders being situated in an interior of said at least one container such that the interior compartment of said at least one container is defined between said cylinders and said at least one container.

12. The web cutting device of claim 11, wherein said coupling means comprise a passage between the interior compartment and the chambers behind said pistons in said cylinders.

13. The web cutting device of claim 1, further comprising control means for controlling said means for coupling said chambers defined in part by said pistons to the interior compartment of said at least one container.

14. The web cutting device of claim 13, wherein said means for coupling said chambers defined in part by said pistons to the interior compartment comprise a passage between each of said pistons and the interior compartment of said at least one container, said control means comprising a control valve arranged at least partially in said passage defined between each of said pistons and the interior compartment of said at least one container, each of said control valves opening a respective one of said passages upon a difference in pressure between a portion of said control valve exposed to the interior compartment and another portion of said control valve not exposed to the interior compartment.

15. The web cutting device of claim 14, wherein a surface area of said portion of said control valve exposed to the interior compartment in a first closed position of said control valve is less than a surface area of said portion of said control valve exposed to the interior compartment in a second open position of said control valve.

* * * * *